United States Patent [19]

McCarthy

[11] 4,098,469

[45] Jul. 4, 1978

[54] TOILET PAPER ROLL HOLDER

[76] Inventor: Joseph J. McCarthy, P.O. Box 326, Antrim, N.H. 03440

[21] Appl. No.: 844,479

[22] Filed: Oct. 21, 1977

[51] Int. Cl.[2] ..... A47K 10/22

[52] U.S. Cl. ..... 242/55.3; 242/55.53; 312/39

[58] Field of Search ..... 242/55.3, 55.53, 55.54, 242/55.55, 55.42, 58; 312/39, 40, 41

[56] References Cited

U.S. PATENT DOCUMENTS

| | | | |
|---|---|---|---|
| 1,607,302 | 11/1926 | Pentecost | 242/55.3 |
| 3,279,715 | 10/1966 | Yedvig | 242/55.3 |
| 3,754,719 | 8/1973 | Choy | 242/55.3 |
| 3,930,696 | 1/1976 | Hight et al. | 312/39 |

*Primary Examiner*—George F. Mautz

*Attorney, Agent, or Firm*—Fisher, Christen & Sabol

[57] ABSTRACT

A toilet paper holder having an elongated extended chute of suitable dimensions for holding a plurality of rolls of toilet paper in vertical stacked relation, the rolls being mounted on a hollow core which are substantially horizontal in said stacked relation and a chute having front, back, side, bottom and top walls. The front wall is provided with an opening near the bottom to permit the insertion and removal of rolls of toilet paper and the side walls near the opening are provided with substantially horizontal grooves for receiving the hinge pins of a door adapted to close the opening. A removable spindle is provided for extending through the hollow core of the lowermost roll to hold it in position. The device of the present invention provides for the storage of toilet paper at the site of use, provides a decorative and pleasing appearance permitting the toilet paper to be hidden from view when not in use. In addition, the device of this invention permits the easy removal of sheets of toilet paper when needed but at the same time is adapted to provide a braking action on the roll in use to prevent accidental unwinding of the sheet of toilet paper from the roll.

6 Claims, 5 Drawing Figures

TOILET PAPER ROLL HOLDER

BACKGROUND OF THE INVENTION

1. Field of the Invention

This invention relates to toilet paper holders and in particular to those types of holders which permit the storage of spare rolls in addition to permitting the dispensing of sheets from a roll in use, while at the same time covering the toilet paper from view to provide an aesthetic and decorative appearance.

2. Description of the Prior Art

There is a considerable amount of prior art on toilet tissue holders and dispensers, however, there is no prior art that discloses or suggests applicant's toilet paper holder and dispenser as disclosed and claimed herein.

U.S. Pat. Nos. 2,603,427, 2,605,975, 3,130,932 and 3,279,715 all disclose toilet paper holders and dispensing devices which are adapted to be recessed into the wall of the room in which they are to be used. In addition, each of these prior art devices expose the roll in use to full view and none of them have provisions for providing a decorative cover for all rolls including the one in use. In addition, these prior art devices are subjected to accidental unrolling of the toilet tissues on the roll.

U.S. Pat. No. 2,840,319 discloses a toilet tissue storage and dispensing receptacle which is designed to be mounted on the wall of the room in which it is used. This prior art receptacle exposes the roll in use to full view and also exposes it to potential damage and accidental unwinding.

U.S. Pat. No. 2,872,264 discloses a paper dispenser which provides for the storage of spare rolls of paper and also obscures the roll in use from view. However, this prior art device requires the use of several moving parts and also requires manipulation of the roll in use by the finger of the operator which is extended through an opening 35 for the purpose of rotating the roll to move its lower end into gripping position. This prior art device sets the stage for potential breakdown and jamming of the internal mechanism of the device. Furthermore, the roll in use, except for the relatively small finger opening 35, is relatively unaccessible in order to adjust the roll in use should it become jammed.

SUMMARY OF THE INVENTION

The present invention provides for the storage and dispensing of rolls of toilet paper and provides a pleasing and decorative appearance while permitting all the rolls, including the one in use, to be hidden from view by a decorative cabinet or cabinet door. By the same token, the present invention permits easy access to the roll which is in use in order to obtain sheets from the roll for use or for the purpose of exchanging rolls or making any other adjustments. The present invention provides for an access door covering the roll in use and which also permits the insertion of several rolls of paper into the device for storage purposes. In addition, the door provides a suitable braking action on the roll to prevent accidental unwinding yet can be easily lifted when it is desired to withdraw sheets from the roll.

DESCRIPTION OF A SPECIFIC EMBODIMENT

Figure 1:
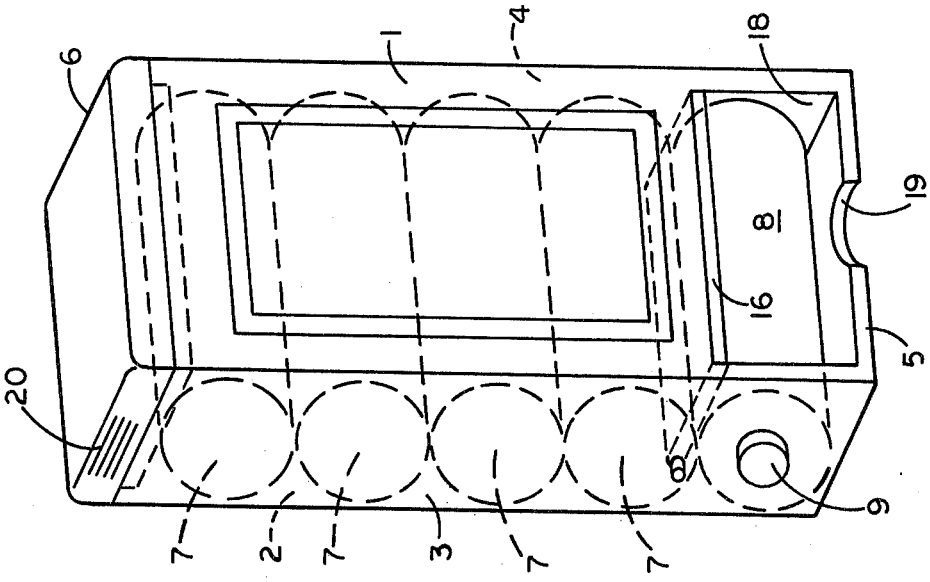
FIG. 1 is a perspective view of the toilet paper storage and dispensing device of this invention illustrating the door in its raised position where the roll in use is somewhat exposed to view and wherein the door provides a braking action on the roll in use.

Referring to FIG. 1, the device of this invention comprises a front wall 1, a back wall 2, side walls 3 and 4, a bottom wall 5, and a top wall 6. The top wall 6 can be formed in such a way that it can be detached or lifted from the front, back and side walls 1, 2, 3 and 4. This permits loading toilet paper rolls through the top of the device. The toilet paper rolls to be stored are designated by reference numeral 7 and the roll in use is indicated by reference numeral 8. The lowermost roll 8, i.e., the roll in use, is held in position by a spindle 9. The side wall 3 is provided with a hole through which the spindle extends and the inner lower surface of side wall 4 is provided with a bracket 10 having a groove 11. The inner end of spindle 9 is supported in the groove 11 of bracket 10. The upper ends of the bracket 10 are beveled or tapered to faciliate insertion of the spindle in the groove. The spindle 9 is formed with a knob 12 to permit easy manipulation of the spindle. Adjacent the knob 12, the spindle is provided with a peripheral groove 13 which receives the side wall 3 when the spindle 9 is passed through the hole provided in said side wall for insertion in the spindle. Groove 13 serves to hold the spindle 9 in position and discourage or prevent it from coming back out of the hole provided in side wall 3.

Figure 5:
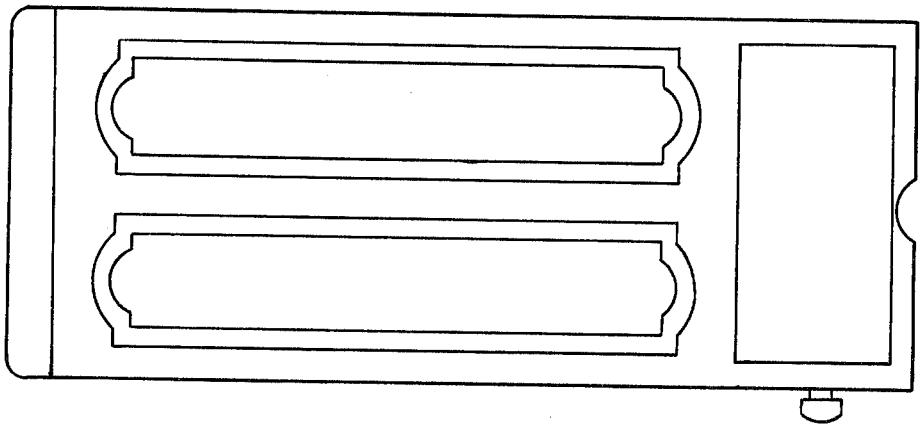
FIG. 5 is a front elevation view of the device of this invention showing the door in its closed position obscuring the rolls from view.
Figure 2:
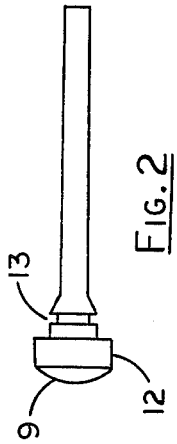
FIG. 2 is a side elevation of the spindle used for insertion through the hollow core of the roll in use.
Figure 3:
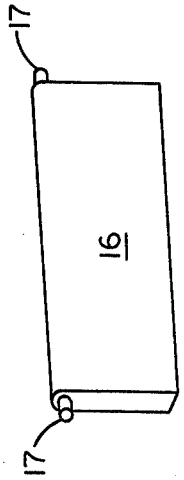
FIG. 3 is a perspective view of the door.
Figure 4:
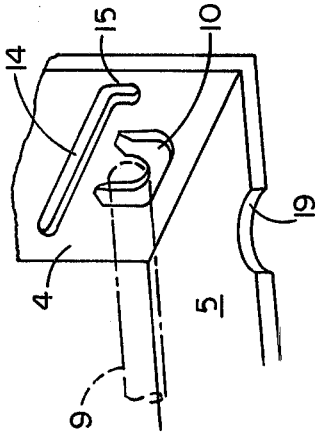
FIG. 4 is a perspective view of a lower corner of the device of this invention illustrating one of the grooves in which the door hinge pin rides.

Each side wall 3 and 4 is provided on its interior surface with a substantially horizontal groove 14 as best shown in FIG. 4 for side wall 4. The grooves 14 of the side walls 3 and 4 are substantially parallel to each other and extend substantially horizontally except for a small portion thereof 15 which extends downwardly near front wall 1. A door 16 having hinge pins 17 is provided. The front wall which is shorter than the back and side walls 2, 3 and 4 thereby leaving an opening 18 in the lower part of the device. The door 16 is adapted to close the opening 18 as desired. In this regard, hinge pins 17 ride in grooves 14 formed in the side walls so that when the door is pulled outwardly, the hinge pins 17 ride towards the opening 18. As the pins 17 reach the downward groove portion 15 they drop into said portion and the door then may be allowed to swing downwardly thereby closing the opening 18. The bottom wall 5 is provided with a cut-out 19 to permit insertion of a finger to facilitate lifting and opening the door 16. It can be readily seen that the door 16, in its horizontal position, serves to hold the storage rolls 7 up and out of the way of the roll 8 being used. By lifting the front end of the door 16, when it is in its horizontal position between the roll in use 8 and the lowermost storage roll, pressure on roll 8 is released and it can be easily rotated to withdraw the desired number of sheets of toilet paper. When the front end of the door 16, in its horizontal position, is no longer lifted but is allowed to drop, it engages the periphery of roll 8 to serve as a brake to prevent it from being accidentally unrolled. If desired, for aesthetic effects, the door 16 can be moved into its vertical position by pulling it horizontally forward. When hinge pins 17 fall into the downward groove portions 15 and the door 16 is allowed to swing downwardly, the door 16 then closes the opening 18 and the downward groove portion 15 serve to prevent the hinge pins 17 from sliding accidentally backwardly in the grooves 14.

The cut-out 19 also permits easier access to the sheets of toilet paper on the roll 8 in use. The cover or top wall 6 can be provided with friction surfaces 20 on its sides to permit easier and more reliable gripping. When the roll in use is empty, the spindle 9 is pulled out to allow the empty core to be discharged whereupon the next roll in line is allowed to drop into position by the appropriate manipulation of door 16. The spindle 9 can then be reinserted through the hollow core of the new roll and the door 16 can be either closed or moved into position between the roll in use 8 and the next uppermost roll 7 above it.

What is claimed is:

1. A toilet paper holder comprising:

(a) an elongated vertically extending chute of suitable dimension for holding in vertical stacked relation a plurality of rolls of paper, said rolls being mounted on a hollow core, said chute having front and back walls, side walls, and top and bottom walls, each said roll having an axis that extends horizontally from side wall to side wall and is substantially parallel to the axis of each other roll;

(b) an opening in said front wall adjacent said bottom wall, said opening being sufficiently large to permit insertion and removal of said rolls;

(c) a groove in the inner face of each said side wall proximate to said opening, each said groove extending from a point adjacent to but spaced from the upper end of said opening toward said back wall, each said groove being parallel to the other said groove;

(d) a door having a pair of hinge pins each extending horizontally from the upper side edge of said door, said pins being disposed in said grooves and guided thereby when the door is pivoted upwardly on said pins and slid towards said back wall; and (e) a removable spindle adapted to extend through the hollow core of the lowermost roll and hold it in position, said spindle being supported by said side walls.

2. Toilet paper holder as claimed in claim 1 wherein said top wall is removable to permit insertion of said rolls of paper.

3. Toilet paper holder as claimed in claim 1 wherein said spindle passes through a hole provided in one said side wall and is supported by a bracket provided on the opposite side wall.

4. Toilet paper holder as claimed in claim 3 wherein said spindle is provided with an annular groove adjacent one end for engagement with said side wall provided with said hole.

5. Toilet paper holder as claimed in claim 1 wherein each said groove dips downwardly a short distance from said opening to provide for a releasable locking action operating on said door.

6. Toilet paper holder as claimed in claim 1 wherein said bottom wall is provided with a cut-out in its front edge portions to provide means facilitating engagement of said door to lift it and slide it rearwardly.

* * * * *